United States Patent [19]

Cuttitta et al.

[11] 3,933,950

[45] Jan. 20, 1976

[54] AIR VALVE CARBURETOR

[75] Inventors: Louis L. Cuttitta, Lapeer, Mich.; Walter S. Falen, Rochester, N.Y.

[73] Assignee: General Motors Corporation, Detroit, Mich.

[22] Filed: May 2, 1974

[21] Appl. No.: 466,204

[52] U.S. Cl. ..... 261/50 A; 92/86; 92/100

[51] Int. Cl.[2] ..... F02M 19/02

[58] Field of Search ..... 261/50 A, DIG. 19, 69 R; 92/98 D, 99, 100, 86, 87

[56] References Cited

UNITED STATES PATENTS 3,851,021 11/1974 Moulds ..... 261/50 A 3,852,391 12/1974 Hisatomi et al..... 261/DIG. 19 X

*Primary Examiner*—Tim R. Miles

*Assistant Examiner*—William Cuchlinski, Jr.

*Attorney, Agent, or Firm*—C. K. Veenstra

[57] ABSTRACT

In an air valve carburetor having a diaphragm positioning the air valve to maintain a constant pressure drop thereacross, a small calibrated hole is provided in the diaphragm to create a continuous flow of air through the diaphragm chamber and thereby purge fuel from and inhibit accumulation of fuel in the diaphragm chamber.

3 Claims, 3 Drawing Figures

AIR VALVE CARBURETOR

This invention relates to a carburetor having a pressure responsive member positioning an air valve to create a controlled metering signal.

Among the well-known carburetors are those in which an air valve is disposed in the inlet to the mixture conduit and is positioned against the bias of a spring by a pressure responsive member to maintain a constant depression in the mixture conduit. The position of the air valve thus is determined by and is a measure of the rate of air flow through the mixture conduit. The constant pressure drop across the air valve is also applied across the fuel in the fuel bowl to create a constant metering head, and a fuel metering rod linked to the air valve controls fuel flow to the mixture conduit. This construction permits close control of the air-fuel ratio supplied by the carburetor over a wide range of air flow rates.

We have found that, in some situations, pressure fluctuations in the mixture conduit can transmit fuel into the chamber behind the pressure responsive member and that this can result in undesirable accumulation of fuel in the chamber and in the tube or passage between the chamber and the mixture conduit. We also have found that fuel can be purged from the chamber and accumulation of fuel in the chamber can be inhibited by providing a small hole in the pressure responsive member to allow a low flow of clean air through the chamber into the mixture conduit.

Therefore, in a preferred embodiment of this invention, the air valve is positioned by a diaphragm, an opening is provided in the diaphragm, and a pair of identical diaphragm backing plates disposed on opposite sides of the diaphragm overlying the opening are provided with calibrated holes to allow a low flow of purge air through the diaphragm chamber.

The details as well as other objects and advantages of this invention are set forth in the remainder of the specification and are shown in the drawings in which.

Figure 1:
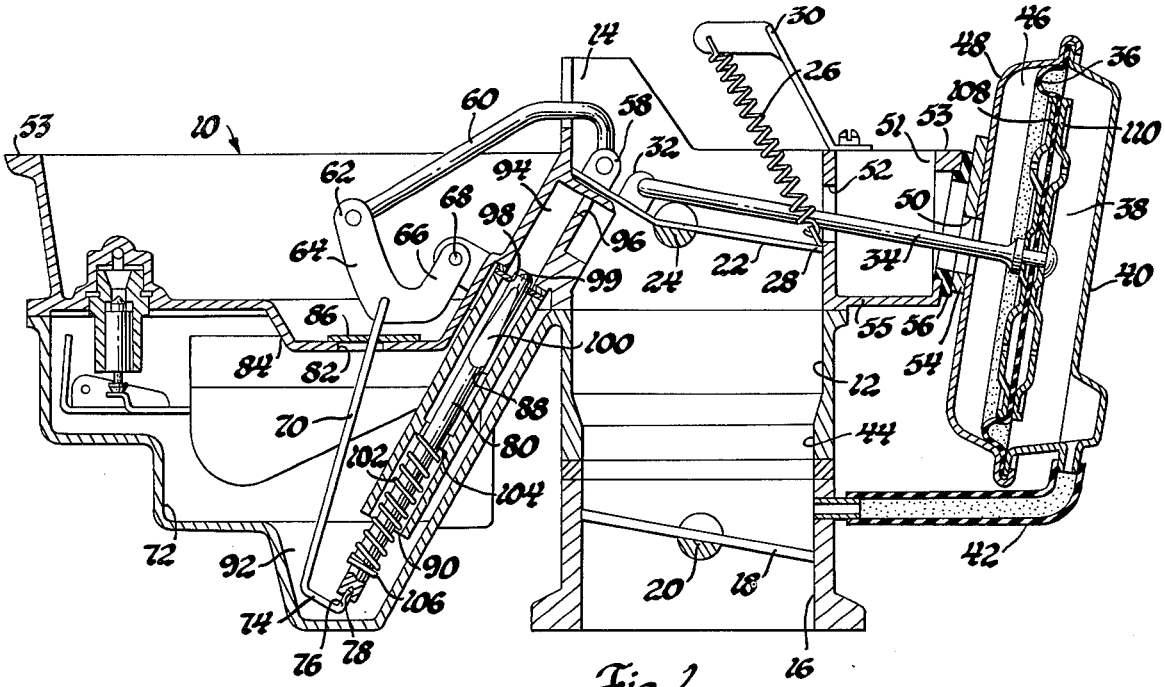
FIG. 1 is a sectional elevational view of an air valve carburetor embodying this invention.

Referring first to FIG. 1, the carburetor 10 has a mixture conduit 12 including an air inlet 14 and a mixture outlet 16 which discharges to the engine. A throttle 18 is disposed in mixture outlet 16 in the usual manner on a throttle shaft 20.

An air valve 22 is disposed in air inlet 14 on an air valve shaft 24. A spring 26 is secured to the downstream edge 28 of air valve 22 and extends to a bracket 30 to bias air valve 22 to the position shown.

A tang 32 reaches upwardly from air valve 22 and is connected by a link 34 to a diaphragm 36. A chamber 38, formed between the right side of diaphragm 36 and a cover member 40, is connected by a tube 42 to a region 44 of mixture conduit 12 defined between air valve 22 and throttle 18.

A chamber 46, defined between the left side of diaphragm 36 and a cover member 48, is subjected to substantially atmospheric pressure, present in air inlet 14 and in the air cleaner (not shown), through openings such as 50, 51 and 52. (The air cleaner seats on a rim 53 disposed about the upper portion of carburetor 10.) Cover member 48 is welded to a bracket 54 which is secured to the air horn 55, and a grommet 56 is disposed between bracket 54 and air horn 55.

In operation, chamber 38 is subjected to the subatmospheric pressure created in region 44 as throttle 18 is opened, and diaphragm 36 acts through link 34 to pull air valve 22 clockwise to an open position. Spring 26 is effective to balance the opening force of diaphragm 36, thereby creating in region 44 a substantially constant pressure about 10 inches of water less than the substantially atmospheric pressure above air valve 22. By thus establishing a generally constant pressure drop across air valve 22, the area about air valve 22 and thus the rotative position of air valve 22 is determined by and is a measure of the rate of air flow through mixture conduit 12.

A tab 58 extends upwardly from air valve 22 and is connected through a link 60 to one end 62 of a lever 64. The opposite end 66 of lever 64 is pivoted about a pin 68. Intermediate ends 62 and 66, a hanger 70 extends from lever 64 into the carburetor fuel bowl 72. The lower end 74 of hanger 70 has a hook 76 which is received in a recess 78 formed in a metering rod 80.

It may be noted that hanger 70 extends through an opening 82 in the fuel bowl cover portion 84 of air horn 55. Opening 82 is closed by a slider 86 which shifts horizontally during movement of hanger 70.

Metering rod 80 is disposed in a fuel passage 88 having its lower end 90 disposed to receive fuel from a well 92 formed in the bottom of fuel bowl 72. The upper end 94 of fuel passage 88 has an opening 96 through which fuel is discharged into region 44 of mixture conduit 12. It will be appreciated, therefore, that the fuel in fuel bowl 72 is subjected to a substantially constant metering head -- from the substantially atmospheric pressure in the upper portion of the fuel bowl to the generally constant pressure in region 44.

A metering jet or orifice 98 is disposed in fuel passage 88 around the tip 99 of metering rod 80. Metering rod 80 has flat tapered surfaces 100 on opposite sides which, upon reciprocation of metering rod 80 in jet 98, varies the area available for fuel flow through jet 98.

In operation, as air valve 22 opens by clockwise rotation, link 60 rotates lever 64 in a clockwise direction. Lever 64 then lifts hanger 70 to move metering rod 80 generally upwardly and rightwardly in fuel passage 88. Thus as air valve 22 is opened to increase the area available for air flow through air inlet 14, metering rod 80 is shifted to increase the area available for fuel flow through metering orifice 98. By this means, a substantially constant air-fuel ratio may be maintained -- the precise proportion being controlled by the geometry of tapered surfaces 100 and of the linkage between air valve 22 and metering rod 80. Modifications of this linkage to provide cold enrichment, power enrichment, and inlet air temperature and pressure compensation are set forth in copending application Ser. No. 343,553 filed Mar. 21, 1973, now U.S. Pat. No. 3,882,206, and the disclosure of that application is incorporated herein by reference.

A spring 102 extends from a ledge 104 formed in fuel passage 88 to the lower end 106 of metering rod 80 to take up any slack in the linkage and to load metering rod 80 against jet 98.

It may be noted that the thickness of metering rod 80 increases from the end of surfaces 100 most closely adjacent passage inlet 90 to tip 99. Tip 99 is therefore enlarged and assists in discharging fuel from fuel passage 88 as air valve 22 and metering rod 80 are moved to increase air and fuel flow. This offsets the greater inertia of the fuel which otherwise could create a mixture temporarily leaner than desired.

Figure 2:
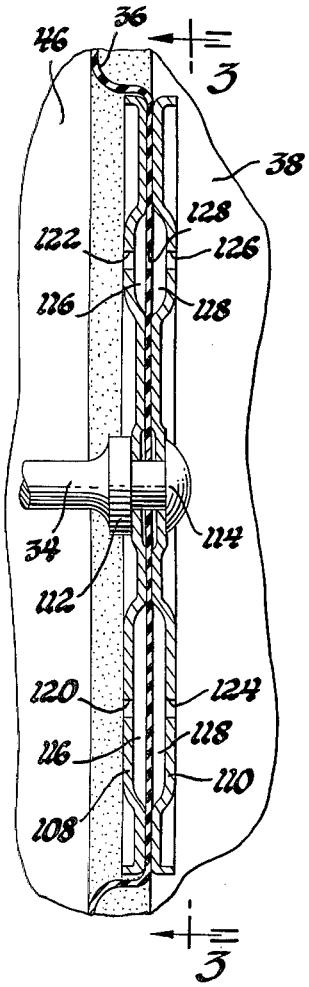
FIG. 2 is a view of a portion of FIG. 1, enlarged to show details of the diaphragm assembly.

As best shown in FIG. 2, diaphragm 36 has a pair of identical backing plates 108 and 110 clamped on opposite sides thereof by enlarged portions 112 and 114 of link 34. The backing plates are formed to provide annular recesses 116 and 118 between the backing plates and diaphragm 36.

Backing plate 108 has a pair of diametrally disposed calibrated holes 120 and 122 opening into recess 116, and backing plate 110 has a pair of diametrally disposed calibrated holes 124 and 126 opening into recess 118. Although the drawing shows holes 120 and 122 in alignment with holes 124 and 126, this disposition is unnecessary with the construction shown.

Figure 3:
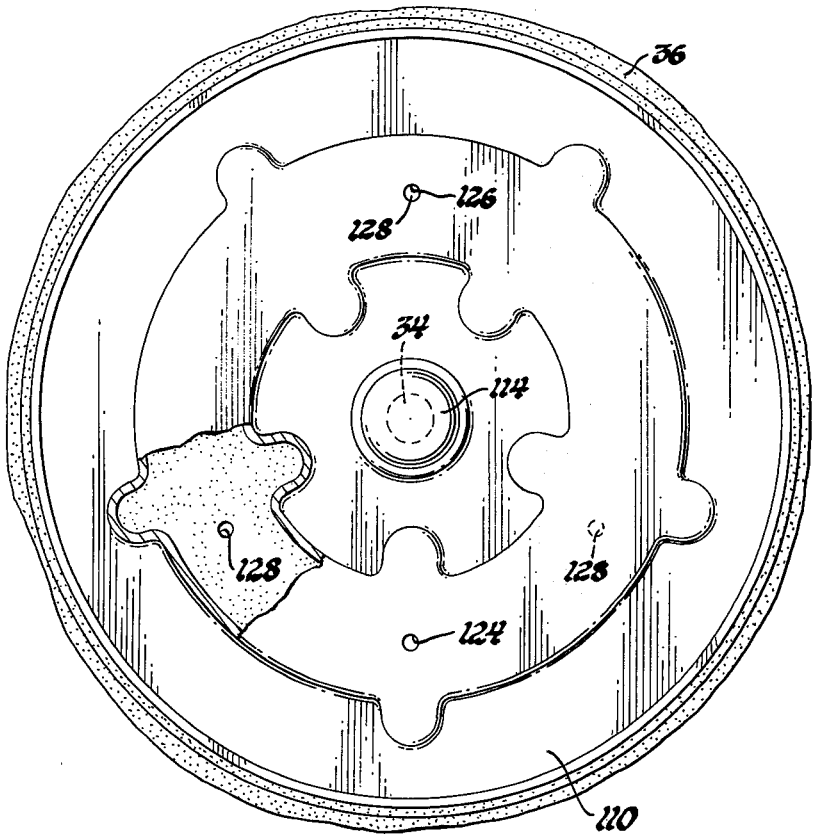
FIG. 3 is a view taken along the line 3—3 of FIG. 2 to show the disposition of the purge holes in the diaphragm and the backing plates.

Diaphragm 36 has a plurality of holes 128 opening from recess 116 to recess 118. Although diaphragm 36 is shown in FIG. 3 as having three holes 120, the size and number of holes 128 is not critical as long as the total area provided by holes 128 is greater than the area of the holes provided in either of backing plates 108 and 110. Further, although the drawing shows one of holes 128 aligned with hole 122 in backing plate 108 and hole 126 in backing plate 110, this disposition is unnecessary with the construction shown.

In operation, the substantially atmospheric pressure in chamber 46 and the subatmospheric pressure in chamber 38 creates a continuous flow of air from chamber 46 through holes 120 and 122 into recess 116, through holes 128 into recess 118, through holes 124 and 126 into chamber 38, and through chamber 38 and tube 42 to region 44. This continuous flow of air purges fuel from and inhibits accumulation of fuel in chamber 38.

In the construction shown, each of holes 120, 122, 124 and 126 has a diameter of 0.030 inch. In some constructions, however, we would prefer to provide only one hole with a diameter of 0.050 inch in each plate. These constructions provide purge air flow through chamber 38 equivalent to that which would occur through a single 0.052 inch hole.

The embodiments of the invention in which an exclusive property or priviledge is claimed are defined as follows:

1. A carburetor comprising a mixture conduit having an air inlet and a mixture outlet, a throttle disposed in said outlet for controlling flow therethrough, an air valve disposed in said air inlet and movable between closed and open positions, means biasing said air valve toward said closed position, a diaphragm connected to said air valve for moving said air valve toward said open position against the bias of said biasing means, one side of said diaphragm being exposed to the pressure in said air inlet upstream of said air valve, and means associated with the other side of said diaphragm for defining therewith an enclosed chamber connected to said mixture conduit between said air valve and said throttle, whereby said diaphragm and said biasing means are effective to position said air valve to establish a selected pressure differential thereacross, and wherein said diaphragm has an opening extending therethrough to permit air to flow continuously from said air inlet upstream of said air valve through said opening and said chamber to said mixture conduit downstream of said air valve to thereby purge fuel from said chamber and inhibit accumulation of fuel in said chamber and a plate overlying said opening and having a calibrated hole restricting air flow through said opening to control the rate thereof.

2. A carburetor comprising a mixture conduit having an air inlet and a mixture outlet, a throttle disposed in said outlet for controlling flow therethrough, an air valve disposed in said air inlet and movable between closed and open positions, a spring biasing said air valve toward said closed position, a diaphragm having a link extending to said air valve for moving said air valve toward said open position against the bias of said spring, one side of said diaphragm being exposed to the pressure in said air inlet upstream of said air valve, a cover associated with the opposite side of said diaphragm to define an enclosed chamber therebetween, means defining a passage connecting said chamber to said mixture conduit between said air valve and said throttle, whereby said diaphragm and said spring are effective to position said air valve to establish a selected pressure differential thereacross, a backing plate secured on one side of said diaphragm and defining a recess therebetween, said diaphragm having a hole opening to said recess, and said backing plate having a calibrated hole opening to said recess whereby air may flow from said air inlet upstream of said air valve through said diaphragm, said recess, said backing plate, said chamber and said passage to said mixture conduit downstream of said air valve at a rate determined by the size of said calibrated hole to thereby purge fuel from said chamber and inhibit accumulation of fuel in said chamber.

3. A carburetor comprising a mixture conduit having an air inlet and a mixture outlet, a throttle disposed in said outlet for controlling flow therethrough, an air valve disposed in said air inlet and movable between closed and open positions, a spring biasing said air valve toward said closed position, a diaphragm having a link extending to said air valve for moving said air valve toward said open position against the bias of said spring, one side of said diaphragm being exposed to the pressure in said air inlet upstream of said air valve, a cover associated with the opposite side of said diaphragm to define an enclosed chamber therebetween, means defining a passage connecting said chamber to said mixture conduit between said air valve and said throttle, whereby said diaphragm and said spring are effective to position said air valve to establish a selected pressure differential thereacross, a first backing plate secured on said one side of said diaphragm and defining a first annular recess therebetween, a second backing plate identical to said first backing plate secured on said opposite side of said diaphragm and defining a second annular recess therebetween, said first backing plate having a calibrated opening extending from said air inlet upstream of said air valve to said first recess, said diaphragm having an opening extending between said recesses, and said second backing plate having a calibrated opening extending from said second recess to said chamber, whereby air may flow from said air inlet upstream of said air valve through said first backing plate and recess, said diaphragm, said second recess and backing plate, and said chamber and passage to said mixture conduit below said air valve at a rate determined by the size of said calibrated openings to purge fuel from said chamber and to inhibit accumulation of fuel in said chamber.

* * * * *